US009878225B2

(12) United States Patent
Kogawa et al.

(10) Patent No.: US 9,878,225 B2
(45) Date of Patent: Jan. 30, 2018

(54) GOLF CLUB SHAFT AND GOLF CLUB USING THE SAME

(71) Applicant: Fujikura Rubber Ltd., Koto-ku, Tokyo (JP)

(72) Inventors: Yoshihito Kogawa, Saitama (JP); Masaki Wakabayashi, Saitama (JP)

(73) Assignee: FUJIKURA RUBBER LTD., Koto-Ku, Tokyo (JP)

( * ) Notice: Subject to any disclaimer, the term of this patent is extended or adjusted under 35 U.S.C. 154(b) by 118 days.

(21) Appl. No.: 15/101,473

(22) PCT Filed: Dec. 6, 2013

(86) PCT No.: PCT/JP2013/082769
§ 371 (c)(1),
(2) Date: Jun. 3, 2016

(87) PCT Pub. No.: WO2015/083277
PCT Pub. Date: Jun. 11, 2015

(65) Prior Publication Data

US 2016/0367873 A1 Dec. 22, 2016

(51) Int. Cl.
*A63B 53/10* (2015.01)
*A63B 53/12* (2015.01)
(Continued)

(52) U.S. Cl.
CPC ..... *A63B 53/10* (2013.01); *A63B 53/12* (2013.01); *A63B 53/14* (2013.01); *A63B 60/08* (2015.10);
(Continued)

(58) Field of Classification Search
CPC ..... A63B 53/10; A63B 53/12; A63B 53/14; A63B 2209/023; A63B 2209/02; A63B 2209/026; A63B 60/08
(Continued)

(56) References Cited

U.S. PATENT DOCUMENTS 6,106,413 A * 8/2000 Kusumoto ..... A63B 53/10 473/319
6,306,047 B1 10/2001 Kusumoto
(Continued)

FOREIGN PATENT DOCUMENTS

JP 09-131422 A 5/1997
JP 10-000694 A 1/1998
(Continued)

OTHER PUBLICATIONS

International Search Report for Application No. PCT/JP2013/082769.
(Continued)

*Primary Examiner* — Benjamin Layno
(74) *Attorney, Agent, or Firm* — McCormick, Paulding & Huber LLP

(57) ABSTRACT

A golf club shaft formed by winding prepregs, made of reinforced fibers impregnated with a thermosetting resin, into layers and thermally curing the prepregs. The golf club shaft includes a 90-degree prepreg, a fiber direction of which is orthogonal to a longitudinal direction of the golf club shaft and which is provided on each of an inner layer side and an outer layer side, and the golf club shaft satisfies the following condition: $2.0 \leq D2/D1 \leq 4.0$, wherein D1 designates a thickness of the inner-layer-side 90-degree prepreg, and D2 designates a thickness of the outer-layer-side 90-degree prepreg.

10 Claims, 6 Drawing Sheets

| PREPREG | DISTAL-END PLY NUMBER | PROXIMAL-END PLY NUMBER | ANGLE(°) | SHEET THICKNESS (mm) | SHAFT WALL THICKNESS (mm) | SHEET WEIGHT (g) | PREPREG SHAPE |
|---|---|---|---|---|---|---|---|
| P1 | 1 | 1 | 90 | 0.023 | 0.023 | 1.41 | |
| P2 | 3 | 3 | +45 | 0.023 | 0.069 | 4.36 | |
| P3 | 3 | 3 | −45 | 0.023 | 0.069 | 4.36 | |
| P4 | 1 | 1 | +45 | 0.023 | | 0.24 | |
| P5 | 1 | 1 | −45 | 0.023 | | 0.24 | |
| P6 | 1 | 1 | 0 | 0.063 | | 1.01 | |
| P7 | 1 | 1 | 0 | 0.081 | 0.081 | 5.51 | |
| P8 | 1 | 1 | 90 | 0.061 | 0.061 | 4.23 | |
| P9 | 1 | 1 | 0 | 0.081 | 0.081 | 5.66 | |
| P10 | 1 | 1 | 0 | 0.081 | 0.038 | 2.63 | |
| P11 | / | / | 0 | 0.061 | | 1.35 | |

THICKNESS OF SHAFT THINNEST PORTION : 0.422(mm) TOTAL WEIGHT OF SHAFT : 31.00(g)

(51) Int. Cl.
*A63B 53/14* (2015.01)
*A63B 60/08* (2015.01)

(52) U.S. Cl.
CPC ..... *A63B 2209/02* (2013.01); *A63B 2209/023* (2013.01); *A63B 2209/026* (2013.01)

(58) Field of Classification Search
USPC ..... 473/319, 320, 321, 316, 301, 289
See application file for complete search history.

(56) References Cited

U.S. PATENT DOCUMENTS

| | | | | |
|---|---|---|---|---|
| 6,767,422 | B1 * | 7/2004 | Atsumi | A63B 53/10 156/184 |
| 2009/0069109 | A1 * | 3/2009 | Kumamoto | A63B 53/10 473/289 |
| 2012/0165113 | A1 | 6/2012 | Kato | |
| 2012/0295734 | A1 * | 11/2012 | Hasegawa | A63B 53/10 473/319 |
| 2012/0295735 | A1 * | 11/2012 | Matsumoto | A63B 53/10 473/319 |
| 2013/0095949 | A1 | 4/2013 | Hasegawa et al. | |
| 2013/0137530 | A1 | 5/2013 | Ito | |
| 2013/0231201 | A1 * | 9/2013 | Matsunaga | A63B 53/10 473/319 |
| 2014/0106895 | A1 * | 4/2014 | Hasegawa | A63B 53/10 473/319 |

FOREIGN PATENT DOCUMENTS

| | | | |
|---|---|---|---|
| JP | 11-070197 | A | 3/1999 |
| JP | 2000-051413 | A | 2/2000 |
| JP | 2000-189547 | A | 7/2000 |
| JP | 2007-117306 | A | 5/2007 |
| JP | 2010252813 | A | 11/2010 |
| JP | 2012-130533 | A | 7/2012 |
| JP | 2013-081693 | A | 5/2013 |
| JP | 2013-116207 | A | 6/2013 |
| JP | 2013116207 | A | 6/2013 |

OTHER PUBLICATIONS

Japanese Official Action for Serial No. 2015-551350 dated Oct. 24, 2017 and its Translation.

* cited by examiner

| PREPREG | DISTAL-END PLY NUMBER | PROXIMAL-END PLY NUMBER | ANGLE(°) | SHEET THICKNESS (mm) | SHAFT WALL THICKNESS (mm) | SHEET WEIGHT (g) | PREPREG SHAPE |
|---|---|---|---|---|---|---|---|
| P1 | 1 | 1 | 90 | 0.023 | 0.023 | 1.41 | |
| P2 | 3 | 3 | +45 | 0.023 | 0.069 | 4.36 | |
| P3 | 3 | 3 | −45 | 0.023 | 0.069 | 4.36 | |
| P4 | 1 | 1 | +45 | 0.023 | | 0.24 | |
| P5 | 1 | 1 | −45 | 0.023 | | 0.24 | |
| P6 | 1 | 1 | 0 | 0.063 | | 1.01 | |
| P7 | 1 | 1 | 0 | 0.081 | 0.081 | 5.51 | |
| P8 | 1 | 1 | 90 | 0.061 | 0.061 | 4.23 | |
| P9 | 1 | 1 | 0 | 0.081 | 0.081 | 5.66 | |
| P10 | 1 | 1 | 0 | 0.081 | 0.038 | 2.63 | |
| P11 | / | / | 0 | 0.061 | | 1.35 | |

THICKNESS OF SHAFT THINNEST PORTION : 0.422(mm) TOTAL WEIGHT OF SHAFT : 31.00(g)

| PREPREG | DISTAL-END PLY NUMBER | PROXIMAL-END PLY NUMBER | ANGLE(°) | SHEET THICKNESS (mm) | SHAFT WALL THICKNESS (mm) | SHEET WEIGHT (g) | PREPREG SHAPE |
|---|---|---|---|---|---|---|---|
| P1-1 | 1 | 1 | 90 | 0.047 | 0.047 | 2.97 | |
| P2 | 3 | 3 | +45 | 0.023 | 0.069 | 4.36 | |
| P3 | 3 | 3 | −45 | 0.023 | 0.069 | 4.36 | |
| P4 | 1 | 1 | +45 | 0.023 | | 0.24 | |
| P5 | 1 | 1 | −45 | 0.023 | | 0.24 | |
| P6 | 1 | 1 | 0 | 0.063 | | 1.01 | |
| P7 | 1 | 1 | 0 | 0.081 | 0.081 | 5.51 | |
| P8-1 | 1 | 1 | 90 | 0.047 | 0.047 | 3.23 | |
| P9 | 1 | 1 | 0 | 0.081 | 0.081 | 5.66 | |
| P10 | 1 | 1 | 0 | 0.081 | 0.03 | 2.07 | |
| P11 | / | / | 0 | 0.061 | | 1.35 | |

THICKNESS OF SHAFT THINNEST PORTION : 0.424(mm) TOTAL WEIGHT OF SHAFT : 31.00(g)

| PREPREG | DISTAL-END PLY NUMBER | PROXIMAL-END PLY NUMBER | ANGLE(°) | SHEET THICKNESS (mm) | SHAFT WALL THICKNESS (mm) | SHEET WEIGHT (g) | PREPREG SHAPE |
|---|---|---|---|---|---|---|---|
| P1-2 | 1 | 1 | 90 | 0.061 | 0.061 | 3.89 | |
| P2 | 3 | 3 | +45 | 0.023 | 0.069 | 4.36 | |
| P3 | 3 | 3 | −45 | 0.023 | 0.069 | 4.36 | |
| P4 | 1 | 1 | +45 | 0.023 | | 0.24 | |
| P5 | 1 | 1 | −45 | 0.023 | | 0.24 | |
| P6 | 1 | 1 | 0 | 0.063 | | 1.01 | |
| P7 | 1 | 1 | 0 | 0.081 | 0.081 | 5.51 | |
| P8-2 | 1 | 1 | 90 | 0.023 | 0.023 | 1.53 | |
| P9 | 1 | 1 | 0 | 0.081 | 0.081 | 5.66 | |
| P10 | 1 | 1 | 0 | 0.081 | 0.041 | 2.85 | |
| P11 | / | / | 0 | 0.061 | | 1.35 | |

THICKNESS OF SHAFT THINNEST PORTION : 0.425(mm) TOTAL WEIGHT OF SHAFT : 31.00(g)

| PREPREG | DISTAL-END PLY NUMBER | PROXIMAL-END PLY NUMBER | ANGLE(°) | SHEET THICKNESS (mm) | SHAFT WALL THICKNESS (mm) | SHEET WEIGHT (g) | PREPREG SHAPE |
|---|---|---|---|---|---|---|---|
| P1-3 | 1 | 1 | 90 | 0.081 | 0.081 | 5.18 | |
| P2 | 3 | 3 | +45 | 0.023 | 0.069 | 4.36 | |
| P3 | 3 | 3 | -45 | 0.023 | 0.069 | 4.36 | |
| P4 | 1 | 1 | +45 | 0.023 | | 0.24 | |
| P5 | 1 | 1 | -45 | 0.023 | | 0.24 | |
| P6 | 1 | 1 | 0 | 0.063 | | 1.01 | |
| P7 | 1 | 1 | 0 | 0.081 | 0.081 | 5.51 | |
| P9 | 1 | 1 | 0 | 0.081 | 0.081 | 5.66 | |
| P10 | 1 | 1 | 0 | 0.081 | 0.044 | 3.09 | |
| P11 | / | / | 0 | 0.061 | | 1.35 | |

THICKNESS OF SHAFT THINNEST PORTION : 0.425(mm) TOTAL WEIGHT OF SHAFT : 31.00(g)

| PREPREG | DISTAL-END PLY NUMBER | PROXIMAL-END PLY NUMBER | ANGLE(°) | SHEET THICKNESS (mm) | SHAFT WALL THICKNESS (mm) | SHEET WEIGHT (g) | PREPREG SHAPE |
|---|---|---|---|---|---|---|---|
| P1 | 1 | 1 | 90 | 0.023 | 0.023 | 1.41 | |
| P2-4 | 1.5 | 1.5 | +45 | 0.047 | 0.071 | 4.36 | |
| P3-4 | 1.5 | 1.5 | −45 | 0.047 | 0.071 | 4.36 | |
| P4 | 1 | 1 | +45 | 0.023 | | 0.24 | |
| P5 | 1 | 1 | −45 | 0.023 | | 0.24 | |
| P6 | 1 | 1 | 0 | 0.063 | | 1.01 | |
| P7 | 1 | 1 | 0 | 0.081 | 0.081 | 5.51 | |
| P8 | 1 | 1 | 90 | 0.061 | 0.061 | 4.23 | |
| P9 | 1 | 1 | 0 | 0.081 | 0.081 | 5.66 | |
| P10 | 1 | 1 | 0 | 0.081 | 0.037 | 2.63 | |
| P11 | / | / | 0 | 0.061 | | 1.35 | |

THICKNESS OF SHAFT THINNEST PORTION : 0.425(mm) TOTAL WEIGHT OF SHAFT : 31.00(g)

GOLF CLUB SHAFT AND GOLF CLUB USING THE SAME

CROSS-REFERENCE TO RELATED APPLICATION

This application is entitled to the benefit of and incorporates by reference subject matter disclosed in the International Patent Application No. PCT/JP2013/082769 filed on Dec. 6, 2013.

TECHNICAL FIELD

The present invention relates to a golf club shaft and a golf club using the same.

BACKGROUND ART

Instead of golf club shafts made of steel, golf club shafts made of FRP (Fiber Reinforced Plastics) which are formed by winding prepregs, made of reinforced fibers (e.g., carbon fibers) impregnated with a thermosetting resin, into layers and thermally curing the same have been widely used.

FIG. 6 is a schematic perspective view illustrating a configuration example of a typical conventional golf club shaft 1. The golf club shaft 1 includes a compressive rigidity (crush rigidity) holding layer 2, a torsional rigidity holding layer 3 and a bending rigidity holding layer 4, in that order toward the outer layer side from the inner layer side. The compressive rigidity holding layer 2 is configured of a prepreg (90-degree (hoop) layer prepreg) whose fiber direction is orthogonal to the longitudinal direction of the shaft, the torsional rigidity holding layer 3 is configured of a prepreg (biasing prepreg; prepreg of a 45-degree layer) whose fiber direction is inclined to the longitudinal direction of the shaft, and the bending rigidity holding layer 4 is configured of a prepreg (prepreg of a 0-degree layer) whose fiber direction is parallel to the longitudinal direction of the shaft. The compressive rigidity holding layer 2 is sometimes layered on top of the torsional rigidity holding layer 3. The prepregs configuring the compressive rigidity holding layer 2 and the bending rigidity holding layer 4 are usually referred to as UD (unidirectional) prepregs since the fibers thereof extend in a single direction. Furthermore, the torsional rigidity holding layer 3 usually includes a pair of UD prepregs (45-degree layers/biasing prepregs) whose fiber directions are symmetrical with respect to the longitudinal direction of the shaft (generally ±45° relative to the longitudinal direction); in addition, the applicant of the present invention has also developed the golf club shaft 1 in which a plain weave fabric (biaxial woven fabric) prepreg, a triaxial woven fabric prepreg and a tetra-axial woven fabric prepreg that are made by impregnating a plain weave fabric (biaxial woven fabric), a triaxial woven fabric and a tetra-axial woven fabric with a thermosetting resin, respectively, are incorporated in the torsional rigidity holding layer 3.

On the other hand, the trend in weight reduction of golf club shafts of recent years has been significant, and the applicant of the present invention has been promoting the development of ultra-lightweight golf club shafts having a total weight of 35 grams or less.

A simple manner of reducing the weight of a golf club shaft is to reduce the number of prepregs constituting the golf club shaft and to reduce the total weight by reducing the thickness and density of each prepreg. However, when it is attempted to achieve reduction in weight of a golf club shaft to the limit, e.g., a reduction to 35 grams or less, this attempt is always accompanied by the problem of reduction in the strength (especially bending strength and torsional strength) of the golf club shaft, thus increasing the possibility of the gold club shaft being damaged. In other words, in the technical field of golf club shafts, there is basically a trade-off relationship between the shaft weight reduction and shaft strength maintenance, and conventional golf club shafts are still incapable of meeting the demand for both shaft weight reduction and shaft strength maintenance.

SUMMARY

The present invention has been devised in view of the above described problems, and an object of the present invention is to achieve a golf club shaft capable of meeting the demand for both weight reduction of the shaft (e.g., a reduction to 35 grams or less in total weight) and maintenance of the strength (especially bending strength and torsional strength) of the shaft, and a golf club using such a golf club shaft.

The inventors of the present invention have achieved the present invention, through extensive research, based on the findings that the demand for both weight reduction of the shaft (e.g., a reduction to 35 grams or less in total weight) and maintenance of the strength (especially bending strength and torsional strength) of the shaft can be met by providing the shaft, on each of the inner layer side and the outer layer side, with a 90-degree prepreg whose fiber direction is orthogonal to the longitudinal direction of the shaft, and optimally setting the thickness of the inner-layer-side 90-degree prepreg and the thickness of the outer-layer-side 90-degree prepreg.

The golf club shaft according to the present invention, which is formed by winding prepregs, made of reinforced fibers impregnated with a thermosetting resin, into layers and thermally curing the prepregs, includes an innermost-layer 90-degree prepreg, a fiber direction of which is orthogonal to a longitudinal direction of the golf club shaft and which is provided at an innermost layer; an outer-layer-side 90-degree prepreg, a fiber direction of which is orthogonal to the longitudinal direction of the golf club shaft and which is provided on an outer layer side; and a sandwich structure in which a pair of bias prepregs, a 0-degree prepreg configured of a full-length layer extending over an entire length of the golf club shaft, and a reinforcing prepreg are interposed between the innermost-layer 90-degree prepreg and the outer-layer-side 90-degree prepreg, wherein fiber directions of the pair of bias prepregs are symmetrical with respect to the longitudinal direction of the golf club shaft, a fiber direction of the 0-degree prepreg is parallel to the longitudinal direction of the golf club shaft, and the reinforcing prepreg is wound around only a distal end of the golf club shaft. Each of 90-degree prepreg that is at the innermost layer and the 90-degree prepreg that is at the outer layer side is configured of a full-length layer extending over an entire length of the golf club shaft. The golf club shaft satisfies the following condition (1):

$$2.0 \leq D2/D1 \leq 4.0, \quad (1)$$

wherein D1 designates the thickness of the innermost-layer 90-degree prepreg and D2 designates the thickness of the outer-layer-side 90-degree prepreg.

It is desirable for the golf club shaft to satisfy the following conditions (2) and (3):

$$0.01 \leq D1 \leq 0.05, \text{ and} \quad (2)$$

$$0.04 \leq D2 \leq 0.10. \quad (3)$$

The term the thickness D1 of the inner-layer-side 90-degree prepreg refers to "the thickness of the inner-layer-side 90-degree prepreg in a state before the prepregs are thermally cured."

The term "the thickness D2 of the outer-layer-side 90-degree prepreg refers to the thickness of the outer-layer-side 90-degree prepreg in a state before the prepregs are thermally cured."

It is desirable for the golf club shaft satisfies the following condition (4):

$$0.01 \leq D3 \leq 0.03, \quad (4)$$

wherein D3 designates a thickness [mm] of each of the pair of biasing prepregs.

The term "the thickness D3 of each of the pair of biasing prepregs" refers to "the thickness of each of the pair of biasing prepregs in a state before the prepregs are thermally cured."

It is desirable for the golf club shaft to further include a second reinforcing prepreg which is wound only around the distal end of the golf club shaft, in addition to the reinforcing prepreg of the sandwich structure, and for the golf club shaft to satisfy the following condition (5):

$$0.3 \leq DT \leq 0.5, \quad (5)$$

wherein DT designates a thickness of a thinnest portion of the golf club shaft, on which the reinforcing prepreg is not wound.

The term "the thickness DT of the thinnest portion of the golf club shaft, around which the reinforcing prepreg is not wound" refers to "the thickness of the thinnest portion of the golf club shaft, around which the reinforcing prepreg is not wound, in a shaft completed state after the prepregs are thermally cured".

It is desirable for the golf club shaft to include a 0-degree prepreg which is arranged on the outer layer side of the sandwich structure, a fiber direction of the 0-degree prepreg being parallel to the longitudinal direction of the golf club shaft. The reinforcing prepreg of the sandwich structure includes a pair of reinforcement biasing prepregs, fiber directions of which are symmetrical with respect to the longitudinal direction of the golf club shaft; and a reinforcing 0-degree prepreg, a fiber direction of which is parallel to the longitudinal direction of the golf club shaft; and a triangular prepreg, a fiber direction of which is parallel to the longitudinal direction of the golf club shaft. The second reinforcing prepreg includes a triangular prepreg, a fiber direction of which is parallel to the longitudinal direction of the golf club shaft. A ratio of the sum of weights of the inner-layer-side 90-degree prepreg and the outer-layer-side 90-degree prepreg to a total weight of the golf club shaft is 20%±3%. A ratio of the sum of weights of the pair of biasing prepregs and the pair of reinforcement biasing prepregs to the total weight of the golf club shaft is 30%±3%. A ratio of the sum of weights of the 0-degree prepregs and the triangular prepreg (P11) to the total weight of the golf club shaft is 50%±3%.

It is desirable for the golf club shaft to include a tapered portion which progressively increases in diameter from a small-diameter distal end of the golf club shaft toward a large-diameter proximal end side thereof, wherein the golf club shaft satisfies the following condition (6):

$$900 \leq LT \leq 1100, \quad (6)$$

wherein LT designates a length [mm] of the tapered portion in the longitudinal direction of the golf club shaft.

The term "the length LT of the tapered portion in the longitudinal direction of the shaft" refers to "the length of the tapered portion in the longitudinal direction of the shaft in a shaft completed state after the prepregs are thermally cured."

It is desirable for the golf club shaft to satisfy the following condition (7):

$$7.5/1000 \leq TA \leq 8.5/1000, \quad (7)$$

wherein TA designates a taper ratio of said tapered portion.

The term "the taper ratio TA of the tapered portion" refers to "the taper ratio of the tapered portion in a shaft completed state after the prepregs of the shaft are thermally cured."

It is desirable for the golf club shaft to satisfy the following condition (8):

$$0.1 \leq W1/W2 \leq 0.3, \quad (8)$$

wherein W1 designates the sum of weights of the inner-layer-side 90-degree prepreg and the outer-layer-side 90-degree prepreg, and W2 designates the total weight of the golf club shaft.

The term "the sum W1 of the weights of the inner-layer-side 90-degree prepreg and the outer-layer-side 90-degree prepreg" refers to "the sum of the weights of the inner-layer-side 90-degree prepreg and the outer-layer-side 90-degree prepreg in a state before the prepregs are thermally cured."

The term "the total weight W2 of the golf club shaft W2 " refers to "the total weight of the golf club shaft in a shaft completed state after the prepregs are thermally cured."

It is desirable for the total weight of the golf club shaft to be one of equal to and less than 35 grams.

A golf club according to the present invention is one of the above described golf club shafts to which a club head and a grip that are fixed.

According to the present invention, a golf club shaft capable of meeting the demand for both weight reduction of the shaft (e.g., a reduction to 35 grams or less in total weight) and maintenance of the strength (especially bending strength and torsional strength) of the shaft, and a golf club using the same golf club shaft can be achieved.

DETAILED DESCRIPTION

Figure 1:
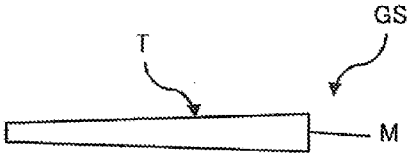
FIG. 1 is a diagram illustrating the laminated structure of the prepregs of a golf club shaft according to the present invention.

FIG. 1 illustrates a laminated structure of the prepregs of a golf club shaft GS according to the present invention. In the diagram shown in FIG. 1, "No. of Turns at Distal End" indicates the number of turns (ply number) of the prepreg on the small-diameter distal end side thereof and "No. of Turns at Proximal End" represents the number of turns (ply number) of the prepreg on the large-diameter proximal end side thereof. "Angle (°)" indicates the angle of the reinforced fibers contained in each prepreg relative to the longitudinal direction of the shaft (0 degree, ±45 degrees or 90 degrees in the present embodiment). "Sheet thickness (mm)" indicates the thickness of each prepreg in a state before the prepregs of the shaft are thermally cured. "Shaft wall thickness (mm)" indicates the thickness of each prepreg (each full-length layer) which constitutes the thinnest portion of the golf club shaft in a shaft completed state after the prepregs of the shaft are thermally cured. "Sheet weight (g)" indicates the weight of each prepreg in a state before the prepregs of the shaft are thermally cured. The thinnest portion of the present embodiment of the golf club shaft GS is 0.422 mm in thickness and 31 grams in total weight.

The golf club shaft GS is formed by winding prepregs, made of reinforced fibers impregnated with a thermosetting resin, into layers and thermally curing the wound prepregs. Various materials such as carbon fibers, alumina fibers, aramid fibers, glass fibers, Tyranno fibers, carbon-silicate fibers, amorphous fibers, etc., can be selectively used as the reinforced fibers. Various materials such as epoxy resin, unsaturated polyester resin, phenolic resin, vinylester resin, PEEK resin, etc., can be selectively used as the thermosetting resin.

The golf club shaft GS has a tapered portion T which progressively increases in diameter from the small-diameter distal end side toward the large-diameter proximal end side. A club head (not shown) is fixed to the small-diameter distal-end of the golf club shaft GS, while a grip (not shown) is fixed to the large-diameter proximal end side of the golf club shaft GS.

The golf club shaft GS is produced by winding, onto a tapered rod-like mandrel (rod-like metal core) M, a single-turn 90-degree prepreg (hereinafter referred to as the inner-layer-side 90-degree prepreg) P1, a pair of biasing prepregs P2 and P3 that are each wound by three turns, a pair of reinforcement biasing prepregs P4 and P5 that are each wound by a single turn, a single-turn reinforcing 0-degree prepreg P6, a single-turn 0-degree prepreg P7, a single-turn 90-degree prepreg (hereinafter referred to as the outer-layer-side 90-degree prepreg) P8, a single-turn 0-degree prepreg P9, a single-turn 0-degree prepreg P10 and a triangular prepreg (reinforcing prepreg) P11, in that order from the inner (lower) layer side toward the outer (upper) layer side; and by pulling out the rod-like mandrel M after these prepregs are thermally cured.

The fiber directions of the inner-layer-side 90-degree prepreg P1 and the outer-layer-side 90-degree prepreg P8 are orthogonal to the longitudinal direction of the shaft. The fiber directions of the pair of biasing prepregs P2 and P3 and the fiber directions of the pair of reinforcement biasing prepregs P4 and P5 are symmetrical (±45° in the present embodiment) with respect to the longitudinal direction of the shaft. The fiber directions of the reinforcing 0-degree prepreg P6, the 0-degree prepreg P7, the 0-degree prepreg P9, the 0-degree prepreg P10 and the triangular prepreg P11 are parallel to the longitudinal direction of the shaft.

The inner-layer-side 90-degree prepreg P1, the pair of biasing prepregs P2 and P3, the 0-degree prepreg P7, the outer-layer-side 90-degree prepreg P8, the 0-degree prepreg P9 and the 0-degree prepreg P10 are full-length layers which extend over the full length of the golf club shaft GS, and are each formed into a trapezoidal shape which narrows toward the small-diameter distal end from the large-diameter distal end so that the ply number is the same along the entire length of each prepreg when wound on the rod-like mandrel M.

The pair of reinforcement biasing prepregs P4 and P5 and the reinforcing 0-degree prepreg P6 are wound only around a portion of the golf club shaft GS in the vicinity of the small-diameter distal end (a portion of the golf club shaft GS in the longitudinal direction thereof) to reinforce the golf club shaft GS thereat. The triangular prepreg P11 is for forming the distal end of the golf club shaft GS into a slate portion corresponding to the hosel diameter of the club head (not shown). A portion of the golf club shaft GS on which the reinforcing prepregs P4 through P6 and the triangular prepreg P11 are not wound, and only the full-length prepregs P1 through P3 and P7 through P10 are wound, is smallest in thickness in the thickness direction thereof.

The present embodiment of the golf club shaft GS has succeeded in meeting the demand for both weight reduction of the shaft (e.g., a reduction to 35 grams or less in total weight; the total weight of the shaft is 31 grams in the present embodiment) and maintenance of the strength (especially bending strength and torsional strength) of the shaft by providing the inner-layer-side 90-degree prepreg P1 and the outer-layer-side 90-degree prepreg P8 on the inner layer side and the outer layer side, respectively, and optimally setting the thickness of the inner-layer-side 90-degree prepreg P1 and the thickness of the outer-layer-side 90-degree prepreg P8.

The conditional (1) defines the ratio between the thickness D1 [mm] of the inner-layer-side 90-degree prepreg P1 and the thickness D2 [mm] of the outer-layer-side 90-degree prepreg P8. By satisfying condition (1), the demands for both weight reduction of the shaft (e.g., a reduction to 35 grams or less in total weight) and maintenance of the strength (especially bending strength) of the shaft are met.

If the upper limit of condition (1) is exceeded, the thickness of the outer-layer-side 90-degree prepreg P8 becomes excessively great compared with the thickness of the inner-layer-side 90-degree prepreg P1, which makes it extremely difficult to achieve a reduction in weight of the shaft (e.g., a reduction to 35 grams or less in total weight).

If the lower limit of condition (1) is exceeded, the thickness of the outer-layer-side 90-degree prepreg P8 becomes excessively small compared with the thickness of the inner-layer-side 90-degree prepreg P1, which causes deterioration in the strength of the shaft (especially bending strength), thus making the shaft susceptible to being damaged.

Condition (2) defines the thickness D1 [mm] of the inner-layer-side 90-degree prepreg P1. By satisfying condition (2), the demands for both weight reduction of the shaft (e.g., a reduction to 35 grams or less in total weight) and maintenance of the strength (especially bending strength) of the shaft can be met.

If the upper limit of condition (2) is exceeded, the thickness of the inner-layer-side 90-degree prepreg P1 becomes excessively great, which makes it extremely difficult to achieve reduction in weight of the shaft (e.g., a reduction to 35 grams or less in total weight).

If the lower limit of condition (2) is exceeded, the thickness of the inner-layer-side 90-degree prepreg P1 becomes excessively small, which causes deterioration in the strength of the shaft (especially bending strength), thus making the shaft susceptible to being damaged.

Condition (3) defines the thickness D2 [mm] of the outer-layer-side 90-degree prepreg P8 . Satisfying condition (3) makes it possible to meet the demands for both weight reduction of the shaft (e.g., a reduction to 35 grams or less in total weight) and maintenance of the strength (especially bending strength) of the shaft.

If the upper limit of condition (3) is exceeded, the thickness of the outer-layer-side 90-degree prepreg P8 becomes excessively great, which makes it extremely difficult to achieve reduction in weight of the shaft (e.g., a reduction to 35 grams or less in total weight).

If the lower limit of condition (3) is exceeded, the thickness of the outer-layer-side 90-degree prepreg P8 becomes excessively small, which causes deterioration in the strength of the shaft (especially bending strength), thus making the shaft susceptible to being damaged.

As described above, in the present embodiment of the golf club shaft GS, the pair of biasing prepregs P2 and P3 that are provided as full-length layers are interposed between the inner-layer-side 90-degree prepreg P1 and the outer-layer-side 90-degree prepreg P8.

With this configuration, condition (4) defines the thickness D3 [mm] of each of the pair of biasing prepregs P2 and P3. Satisfying condition (4) makes it possible to maintain the strength (especially torsional strength) of the shaft and also to wind the pair of biasing prepregs P2 and P3 easily, and thus, facilitate the production of the golf club shaft GS.

If the upper limit of condition (4) is exceeded, the thickness of each of the pair of biasing prepregs P2 and P3 becomes excessively great, and the ply number becomes small in the case where the weights are added up, which results in deterioration in the strength of the shaft (especially torsional strength), thus making the shaft susceptible to being damaged.

If the lower limit of condition (4) is exceeded, the winding of the pair of biasing prepregs P2 and P3 becomes difficult, which consequently makes the production of the golf club shaft GS difficult.

As described above, a portion of the golf club shaft GS, of the present embodiment, on which the reinforcing prepregs P4 through P6 and the triangular prepreg P11 are not wound, and only the full-length prepregs P1 through P3 and P7 through P10 are wound, has the smallest in thickness in the thickness direction thereof.

Condition (5) defines the thickness DT [mm] of the thinnest portion of the golf club shaft GS. Satisfying condition (5) makes it possible to meet the demands for both weight reduction of the shaft (e.g., a reduction to 35 grams or less in total weight) and maintenance of the strength of the shaft.

If the upper limit of condition (5) is exceeded, the thickness of the thinnest portion of the golf club shaft GS becomes excessively great, which makes it extremely difficult to achieve a reduction in weight of the shaft (e.g., a reduction to 35 grams or less in total weight).

If the lower limit of condition (5) is exceeded, the thickness of the thinnest portion of the golf club shaft GS becomes excessively small, which causes deterioration in the strength of the shaft, thus making the shaft susceptible to being damaged.

As described above, the present embodiment of the golf club shaft GS has the tapered portion T, which progressively increases in diameter from the small-diameter distal end side toward the large-diameter proximal end side.

In this configuration, condition (6) defines the length LT [mm] of the tapered portion T in the longitudinal direction of the shaft. Satisfying condition (6) makes it possible to achieve a reduction in weight of the shaft (e.g., a reduction to 35 grams or less in total weight) and also to facilitate the operation of pulling out the golf club shaft GS from the rod-like mandrel M (making the core easier to pull out) during production, and additionally to prevent the large-diameter proximal end (butt end) of the shaft from excessively increasing in thickness.

If the upper limit of condition (6) is exceeded, it becomes extremely difficult to achieve a reduction in weight of the shaft (e.g., a reduction to 35 grams or less in total weight).

If the lower limit of condition (6) is exceeded, it becomes difficult to pull out the golf club shaft GS (difficult to pull out the core) from the rod-like mandrel M during production; in addition, the large-diameter proximal end (butt end) of the shaft becomes excessively great in thickness.

As described above, the present embodiment of the golf club shaft GS has the tapered portion T, which progressively increases in diameter from the small-diameter distal end side toward the large-diameter proximal end side.

With this configuration, condition (7) defines the taper ratio TA of the taper portion T. Satisfying condition (7) makes it possible to achieve a reduction in weight of the shaft (e.g., a reduction to 35 grams or less in total weight) and also to set the bending rigidity and the torsional rigidity of the shaft to within an optimum range.

If the upper limit of condition (7) is exceeded, the bending rigidity and the torsional rigidity of the shaft become excessively high, and it becomes extremely difficult to achieve a reduction in weight of the shaft (e.g., a reduction to 35 grams or less in total weight).

If the lower limit of condition (7) is exceeded, the bending rigidity and the torsional rigidity of the shaft deteriorate, which makes the shaft susceptible to being damaged.

Condition (8) defines the ratio of the sum W1 of the weights of the inner-layer-side 90-degree prepreg P1 and the outer-layer-side 90-degree prepreg P8 (in a state before the prepregs are thermally cured) to the total weight W2 of the golf club shaft GS (in a state after the prepregs are thermally cured). Satisfying condition (8) makes it possible to meet the demands for both weight reduction of the shaft (e.g., a reduction to 35 grams or less in total weight) and maintenance of the strength of the shaft.

If the upper limit of condition (8) is exceeded, the inner-layer-side 90-degree prepreg P1 and the outer-layer-side 90-degree prepreg P8 become excessively great in weight, which makes it extremely difficult to achieve a reduction in weight of the shaft (e.g., a reduction to 35 grams or less in total weight).

If the lower limit of condition (8) is exceeded, the inner-layer-side 90-degree prepreg P1 and the outer-layer-side 90-degree prepreg P8 become excessively small in weight, which causes deterioration in the strength of the shaft, thus making the shaft susceptible to being damaged.

Table 1 shows values which correspond to conditions (1) through (8) (condition-corresponding numerical values) for the present embodiment of the golf club shaft GS (FIG. 1). As made clear from TABLE 1, the present embodiment of the golf club shaft GS satisfies the condition (1) through (8).

TABLE 1

| CONDITION | NUMERICAL VALUES CORRESPONDING TO CONDITIONS |
|---|---|
| (1) $2.0 \leq D2/D1 \leq 4.0$ | 2.65 |
| (2) $0.01 \leq D1 \leq 0.05$ | 0.023 |
| (3) $0.04 \leq D2 \leq 0.10$ | 0.061 |
| (4) $0.01 \leq D3 \leq 0.03$ | 0.023 |
| (5) $0.3 \leq DT \leq 0.5$ | 0.422 |
| (6) $900 \leq LT \leq 1100$ | 960 |

TABLE 1-continued

| CONDITION | NUMERICAL VALUES CORRESPONDING TO CONDITIONS |
|---|---|
| (7) 7.5/1000 ≤ TA ≤ 8.5/1000 | 8.0/1000 |
| (8) 0.1 ≤ W1/W2 ≤ 0.3 | 0.182 |

Table 2 shows the weights of the 0-degree layers (which correspond to the prepregs P6, P7 and P9 through P11), the 45-degree layers (which correspond to the prepregs P2 through P5) and the 90-degree layers (which correspond to the prepregs P1 and P8) that occupy in the total shaft weight (31 grams) of the present embodiment of the golf club shaft GS (FIG. 1), and also shows the ratios of the weights of the 0-degree layers, the 45-degree layers and the 90-degree layers to the total shaft weight of the present embodiment of the golf club shaft GS. As shown in TABLE 2, in the present embodiment of the golf club shaft GS, the ratios of the weights of the 0-degree layers, the 45-degree layers and the 90-degree layers to the total shaft weight are approximately 50%(50%±3%) approximately 30% (30%±3%)) and approximately 20% (20%±3%), respectively, in the case where the total shaft weight is taken as 100 percent.

TABLE 2

| ANGLE | WEIGHT (g) | RATIO (%) |
|---|---|---|
| 0° | 16.2 | 52.1 |
| 45° | 9.2 | 29.7 |
| 90° | 5.6 | 18.2 |
| TOTAL | 31.0 | 100.0 |

Although the case where the inner-layer-side 90-degree prepreg (innermost-layer 90-degree prepreg) P1 is arranged at the innermost layer has been illustrated by way of example in the above illustrated embodiment, the inner-layer-side 90-degree prepreg P1 does not necessarily have to be arranged at the innermost layer; another innermost layer not shown in the drawings can be arranged on the inner layer side of the inner-layer-side 90-degree prepreg P1.

(Demonstration Experiment to Verify Superiority of Strength of Shaft According to Present Invention)

The inventors of the present invention actually produced the present embodiment of the golf club shaft GS (FIG. 1) and golf club shafts GS1 through GS4 as comparative examples, and have verified the superiority of the strength of the shaft according to the present invention by a demonstration experiment on the golf club shafts thus made. To carry out 3-point bending strength tests and torsional destructive strength tests, which will be discussed later, in a fair manner, the total weight of each of the first through fourth comparative examples of the golf club shafts GS1 through GS4 is set to 31 grams, identical to that of the present embodiment of the golf club shaft GS.

Figure 2:
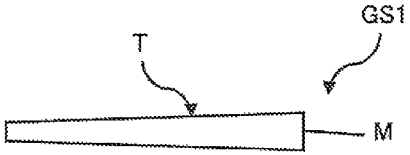
FIG. 2 is a diagram illustrating the laminated structure of the prepregs of a first comparative example of a golf club shaft.

FIG. 2 is a diagram illustrating the laminated structure of the prepregs of the first comparative example of the golf club shaft GS1. The golf club shaft GS1 has the same structure as the present embodiment of the golf club shaft GS (FIG. 1) except that the golf club shaft GS1 is provided, instead of the inner-layer-side 90-degree prepreg P1 (the thickness thereof being 0.023 [mm]) and the outer-layer-side 90-degree prepreg P8 (the thickness thereof being 0.061 [mm]) of the golf club shaft GS, with an inner-layer-side 90-degree prepreg P1-1 and an outer-layer-side 90-degree prepreg P8-1, respectively, which are mutually exactly identical in thickness, each having a thickness of 0.047 [mm]. In the golf club shaft GS1, D2/D1=0.047/0.047=1, thus not satisfying condition (1) of the present invention.

Figure 3:
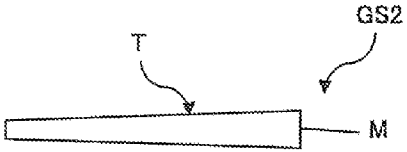
FIG. 3 is a diagram illustrating the laminated structure of the prepregs of a second comparative example of a golf club shaft.

FIG. 3 is a diagram illustrating the laminated structure of the prepregs of the second comparative example of the golf club shaft GS2. The golf club shaft GS2 has the same structure as the present embodiment of the golf club shaft GS (FIG. 1) except that the golf club shaft GS2 is provided with an inner-layer-side 90-degree prepreg P1-2 having a thickness of 0.061 [mm] instead of the inner-layer-side 90-degree prepreg P1 (the thickness thereof being 0.023 [mm]), and is provided with an outer-layer-side 90-degree prepreg P8-2 having a thickness of 0.023 [mm] instead of the outer-layer-side 90-degree prepreg P8 (the thickness thereof being 0.061 [mm]). The golf club shaft GS2 has the same structure as the present embodiment of the golf club shaft GS (FIG. 1) in which the inner-layer-side 90-degree prepreg P1 and the outer-layer-side 90-degree prepreg P8 are inverted in position to serve as the inner-layer-side 90-degree prepreg P1-2 and the outer-layer-side 90-degree prepreg P8, respectively. In the golf club shaft GS2, D2/D1=0.023/0.061=0.38, thus not satisfying condition (1) of the present invention.

Figure 4:
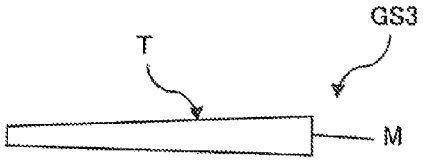
FIG. 4 is a diagram illustrating the laminated structure of the prepregs of a third comparative example of a golf club shaft.

FIG. 4 is a diagram illustrating the laminated structure of the prepregs of the third comparative example of the golf club shaft GS3. The golf club shaft GS3 has the same structure as the present embodiment of the golf club shaft GS (FIG. 1) except that the golf club shaft GS3 is provided with an inner-layer-side 90-degree prepreg P1-3 which is 0.081 [mm] in thickness, instead of the inner-layer-side 90-degree prepreg P1 (the thickness thereof being 0.023 [mm]), with the outer-layer-side 90-degree prepreg P8 (the thickness thereof is 0.061 [mm]) omitted. Since the outer-layer-side 90-degree prepreg does not exist, although the inner-layer-side 90-degree prepreg P1-3 exists, the numerical value corresponding to condition (1) cannot be calculated.

Figure 5:
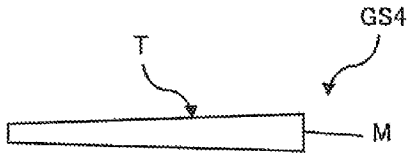
FIG. 5 is a diagram illustrating the laminated structure of the prepregs of a fourth comparative example of a golf club.
Figure 6:
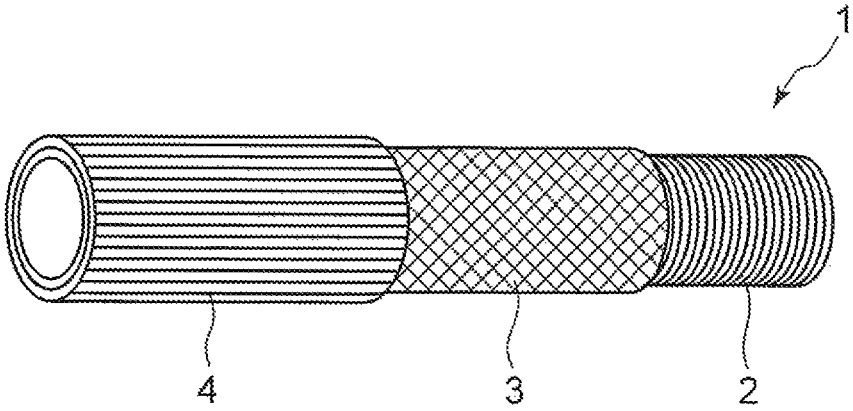
FIG. 6 is a schematic perspective view of a typical conventional golf club shaft, showing a configuration example thereof.

FIG. 5 is a diagram illustrating the laminated structure of the prepregs of the fourth comparative example of the golf club shaft GS4. The golf club shaft GS4 has the same structure as the present embodiment of the golf club shaft GS (FIG. 1) except that the golf club shaft GS4 is provided with a pair of biasing prepregs P2-4 and P3-4 (each of which is 0.047 [mm] in thickness) instead of the pair of biasing prepregs P2 and P3 (each of which is 0.023 [mm] in thickness), respectively. In the golf club shaft GS4, D3=0.047 [mm], thus not satisfying condition (4) of the present invention.

[Strength Test Data 1]

The inventors of the present invention carried out a 3-point bending strength test on each of the products of the present embodiment of the golf club shaft GS and the first through third comparative examples of the golf club shafts GS1 through GS3. Specifically, loads were imposed on the shaft at points 90 mm (T-90), 175 mm (T-175) and 525 mm (T-525) from the distal end of the shaft and at a point 175 mm (B-175) from the proximal end of the shaft; the loads at the moment the shaft was broken were measured.

Tables 3 and 4 show the results of the 3-point bending strength tests. As made clear from Tables 3 and 4, the present embodiment of the golf club shaft GS has exhibited high strength in the 3-point bending strength test compared with the comparative examples of the first through three golf club shafts GS1 through GS3.

TABLE 3

| MEASURED DATA | | | | |
|---|---|---|---|---|
| | 3-POINT BENDING STRENGTH (N) | | | |
| ITEM | T-90 (mm) | T-175 (mm) | T-525 (mm) | B-175 (mm) |
| PRESENT EMBODIMENT | 1510.4 | 534.9 | 513.0 | 576.3 |
| 1st COMPARATIVE EXAMPLE | 1565.4 | 520.6 | 500.1 | 565.9 |
| 2nd COMPARATIVE EXAMPLE | 1475.8 | 488.0 | 447.4 | 444.0 |
| 3rd COMPARATIVE EXAMPLE | 1248.2 | 456.9 | 356.4 | 366.2 |

TABLE 4

| STRENGTH RATIO (WHEN PRESENT EMBODIMENT DEFINED AS 100%) | | | | |
|---|---|---|---|---|
| | 3-POINT BENDING STRENGTH (%) | | | |
| ITEM | T-90 (mm) | T-175 (mm) | T-525 (mm) | B-175 (mm) |
| PRESENT EMBODIMENT | 100.0 | 100.0 | 100.0 | 100.0 |
| 1st COMPARATIVE EXAMPLE | 103.6 | 97.3 | 97.5 | 98.2 |
| 2nd COMPARATIVE EXAMPLE | 97.7 | 91.2 | 87.2 | 77.0 |
| 3rd COMPARATIVE EXAMPLE | 82.6 | 85.4 | 69.5 | 63.5 |

(Strength Test Data 2)

The inventors of the present invention carried out a torsional destructive strength test on each of the products of the present embodiment of the golf club shaft GS and the fourth comparative example of the golf club shaft GS4. Specifically, a destructive force A and a destructive angle B when the shaft is broken by twisting the shaft over the entire length thereof were measured on each shaft.

Tables 5 and 6 show the results of the torsional destructive strength tests. As made clear from Tables 5 and 6, the present embodiment of the golf club shaft GS has exhibited high strength in a torsional destructive strength test compared with the fourth comparative example of the golf club shaft GS4.

TABLE 5

| STRENGTH DATA | | | |
|---|---|---|---|
| | TORTIONAL DESTRUCTIVE STRENGTH | | |
| ITEM | DESTRUCTIVE FORCE A (N * m) | DE-STRUCTIVE ANGLE B (deg) | DESTRUCTIVE FORCE A × DESTRUCTIVE ANGLE B (N * m * deg) |
| PRESENT EMBODIMENT | 11.6 | 142.1 | 1650.7 |
| 4th COMPARATIVE EXAMPLE | 10.7 | 132.3 | 1417.3 |

TABLE 6

| STRENGTH RATIO (WHEN PRESENT EMBODIMENT IS DEFINED AS 100%) | | | |
|---|---|---|---|
| | TORTIONAL DESTRUCTIVE STRENGTH | | |
| ITEM | DESTRUCTIVE FORCE A (%) | DE-STRUCTIVE ANGLE B (%) | DESTRUCTIVE FORCE A × DESTRUCTIVE ANGLE B (%) |
| PRESENT EMBODIMENT | 100.0 | 100.0 | 100.0 |
| 4th COMPARATIVE EXAMPLE | 92.2 | 93.1 | 85.9 |

A golf club shaft according to the present invention and a golf club using this golf club shaft are suitably used in, e.g., playing golf.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A golf club shaft formed by winding prepregs, made of reinforced fibers impregnated with a thermosetting resin, into layers and thermally curing said prepregs, said golf shaft comprising:

an innermost-layer 90-degree prepreg, a fiber direction of which is orthogonal to a longitudinal direction of said golf club shaft and which is provided at an innermost layer, an outer-layer-side 90-degree prepreg, a fiber direction of which is orthogonal to said longitudinal direction of said golf club shaft and which is provided on an outer layer side, a sandwich structure in which a pair of bias prepregs, a 0-degree prepreg configured of a full-length layer extending over an entire length of said golf club shaft, and a reinforcing prepreg are interposed between said innermost-layer 90-degree prepreg and said outer-layer-side 90-degree prepreg, wherein fiber directions of said pair of bias prepregs are symmetrical with respect to said longitudinal direction of said golf club shaft, a fiber direction of said 0-degree prepreg is parallel to said longitudinal direction of said golf club shaft, and said reinforcing prepreg is wound around only a distal end of said golf club shaft, wherein each of 90-degree prepreg that is at said innermost layer and the 90-degree prepreg that is at said outer layer side is configured of a full-length layer extending over an entire length of said golf club shaft, and wherein said golf club shaft satisfies the following condition: $2.0 \leq D2/D1 \leq 4.0$, wherein D1 designates the thickness of said innermost-layer 90-degree prepreg and D2 designates the thickness of said outer-layer-side 90-degree prepreg.

2. The golf club shaft according to claim 1, wherein said golf club shaft satisfies the following conditions: $0.01 \leq D1 \leq 0.05$, and $0.04 \leq D2 \leq 0.10$.

3. The golf club shaft according to claim 1, wherein said golf club shaft satisfies the following condition: $0.01 \leq D3 \leq 0.03$, wherein D3 designates a thickness of each of said pair of biasing prepregs.

4. The golf club shaft according to claim 1, further comprising a second reinforcing prepreg which is wound only around said distal end of said golf club shaft, in addition to said reinforcing prepreg of said sandwich structure, and wherein said golf club shaft satisfies said following condition: $0.3 \leq DT \leq 0.5$, wherein DT designates a thickness of a thinnest portion of said golf club shaft, on which said reinforcing prepreg of said sandwich structure and said second reinforcing prepreg are not wound.

5. The golf club shaft according to claim 4, further comprising a 0-degree prepreg which is arranged on an outer layer side of said sandwich structure, a fiber direction of said 0-degree prepreg being parallel to said longitudinal direction of said golf club shaft, wherein said reinforcing prepreg of said sandwich structure includes:

a pair of reinforcement biasing prepregs, fiber directions of which are symmetrical with respect to said longitudinal direction of said golf club shaft; and a reinforcing 0-degree prepreg, a fiber direction of which is parallel to said longitudinal direction of said golf club shaft, wherein said second reinforcing prepreg includes a triangular prepreg, a fiber direction of which is parallel to said longitudinal direction of said golf club shaft, wherein a ratio of the sum of weights of said innermost-layer 90-degree prepreg and said outer-layer-side 90-degree prepreg to a total weight of said golf club shaft is 20%±3%, wherein a ratio of the sum of weights of said pair of biasing prepregs and said pair of reinforcement biasing prepregs to said total weight of said golf club shaft is 30%±3%, and wherein a ratio of the sum of weights of said 0-degree prepreg arranged between said innermost-layer 90-degree prepreg and said outer-layer-side 90-degree prepreg, said 0-degree prepreg arranged on said outer layer side of said sandwich structure, said reinforcing 0-degree prepreg, and said triangular prepreg to said total weight of said golf club shaft is 50%±3%.

6. The golf club shaft according to claim 1, further comprising a tapered portion which progressively increases in diameter from a small-diameter distal end of said golf club shaft toward a large-diameter proximal end side thereof, wherein said golf club shaft satisfies the following condition: $900 \leq LT \leq 1100$, wherein LT designates a length of said tapered portion in said longitudinal direction of said golf club shaft.

7. The golf club shaft according to claim 6, wherein said golf club shaft satisfies the following condition: $7.5/1000 \leq TA \leq 8.5/1000$, wherein TA designates a taper ratio of said tapered portion.

8. The golf club shaft according to claim 1, wherein said golf club shaft satisfies the following condition: $0.1 \leq W1/W2 \leq 0.3$, wherein W1 designates the sum of weights of said innermost-layer 90-degree prepreg and said outer-layer-side 90-degree prepreg, and W2 designates the total weight of said golf club shaft.

9. The golf club shaft according to claim 1, wherein the total weight of said golf club shaft is one of equal to and less than 35 grams.

10. The golf club comprising said golf club shaft according to claim 1, to which a golf club head and a grip are fixed.

* * * * *